US005507588A

United States Patent [19]

Marts et al.

[11] Patent Number: 5,507,588

[45] Date of Patent: Apr. 16, 1996

[54] RETRACTABLE BARRIER STRIP

[75] Inventors: Donna J. Marts; Stacey G. Barker; Miles A. McQueen, all of Idaho Falls, Id.

[73] Assignee: Lockheed Idaho Technologies Company, Idaho Falls, Id.

[21] Appl. No.: 245,321

[22] Filed: Jul. 13, 1994

[51] Int. Cl.[6] ..... E01F 13/00

[52] U.S. Cl. ..... 404/6; 256/1

[58] Field of Search ..... 404/6, 9, 11, 12; 256/1, 13.1; 403/111, 113, 116, 117

[56] References Cited

U.S. PATENT DOCUMENTS

| | | | |
|---|---|---|---|
| 3,838,760 | 10/1974 | Selby, Jr. | 194/1 R |
| 4,101,235 | 7/1978 | Nelson | 406/6 |
| 4,382,714 | 5/1983 | Hutchinson | 404/6 |
| 4,995,756 | 2/1991 | Kilgrow et al. | 404/6 |
| 5,123,774 | 6/1992 | Dubiel | 404/6 |
| 5,253,950 | 10/1993 | Kilgrow et al. | 404/6 |
| 5,330,285 | 7/1994 | Greves et al. | 404/6 |

FOREIGN PATENT DOCUMENTS 2032983 5/1980 United Kingdom .

*Primary Examiner*—Ramon S. Britts
*Assistant Examiner*—Pamela A. O'Connor
*Attorney, Agent, or Firm*—Hopkins Roden Crockett Hansen & Hoopes

[57] ABSTRACT

A portable barrier strip having retractable tire-puncture means for puncturing a vehicle tire. The tire-puncture means, such as spikes, have an armed position for puncturing a tire and a retracted position for not puncturing a tire. The strip comprises a plurality of barrier blocks having the tire-puncture means removably disposed in a shaft that is rotatably disposed in each barrier block. The shaft removably and pivotally interconnects the plurality of barrier blocks. Actuation cables cause the shaft to rotate the tire-puncture means to the armed position for puncturing a vehicle tire and to the retracted position for not puncturing the tire. Each tire-puncture means is received in a hollow-bed portion of its respective barrier block when in the retracted position. The barrier strip rests stable in its deployed position and substantially motionless as a tire rolls thereon and over. The strip is rolled up for retrieval, portability, and storage purposes, and extended and unrolled in its deployed position for use.

18 Claims, 6 Drawing Sheets

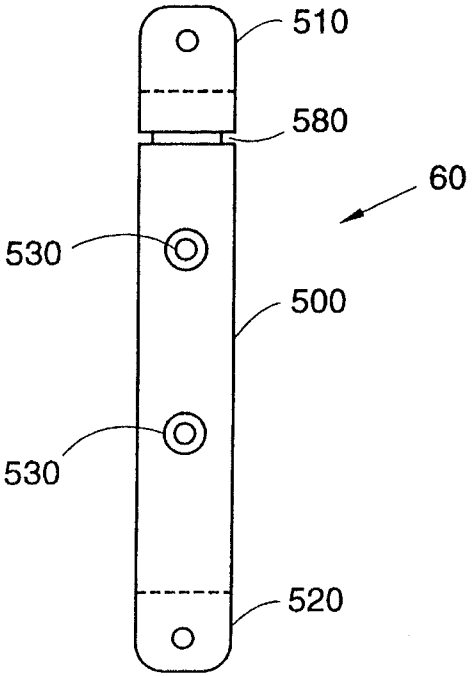
Fig. 5a
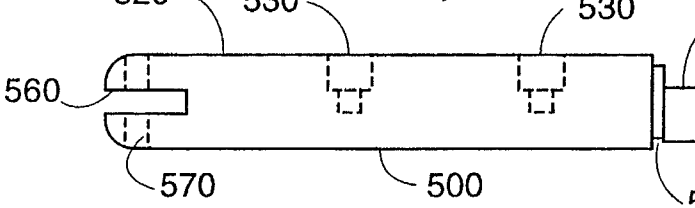
Fig. 5b
Fig. 5c

RETRACTABLE BARRIER STRIP

CONTRACTUAL ORIGIN OF THE INVENTION

The United States Government has rights in this invention pursuant to Contract No. DE-AC07-76ID01570 between the United States Department of Energy and EG&G Idaho, Inc.

TECHNICAL FIELD

This invention relates in general to an apparatus for puncturing a vehicle tire and, in particular, to a portable and retractable barrier strip for puncturing a fleeing vehicle's tire.

BACKGROUND OF THE INVENTION

The need to effectively and safely stop a fleeing vehicle without damage to non-offending vehicles or harm to people involved has long been a concern for law enforcement officials. Consequently, barricades employing spike barrier strips have been used to puncture a fleeing vehicle's tires. Spike barrier strips typically use multiple spikes deployed across a road in the path of a fleeing vehicle to puncture its tires. Examples of existing spike barrier strips are disclosed in U.S. Pat. Nos. 4,382,714 and 4,995,756.

Although prior-art barrier strips are reliable in effectively puncturing the tires of a fleeing vehicle to stop the vehicle, they retain major drawbacks. Namely, in order to stop the fleeing vehicle and yet avoid inadvertent damage to any non-offending vehicles that may be using the same path, the prior-art barrier strips must be deployed in the path of the vehicle either (1) when the area is tightly controlled or (2) only immediately prior to the fleeing vehicle passing. Otherwise, damage to any non-offending vehicles travelling the same path is almost always certain because the sharp, tire-puncture spikes remain exposed at all times during deployment of the barrier.

Since it is difficult to tightly control an area into which a vehicle will flee, it is often required that deployment of a barrier strip occur immediately prior to the passing of the fleeing vehicle to avoid damage to non-offending vehicles. If non-offending vehicles are using the same path, there may only be minimal time after a non-offending vehicle passes in which to deploy the barrier strip before the fleeing vehicle passes. Accordingly, the deploying personnel must remain dangerously near the precise location where the fleeing vehicle will pass and must have a barrier strip in hand and ready to be deployed on a moments notice. As such, it is not uncommon for the deployment personnel to risk being seriously injured by the fleeing vehicle as the barrier strip is deployed or, potentially, by any non-offending vehicles that may be near at the time the strip must be deployed. Moreover, the sharp spikes on existing barrier strips often injure the deployment personnel handling the barrier strip because the spikes remain flagrantly exposed during deployment of the strip.

Obviously, such dangerous and unpredictable situations are not desirable features that accompany the use of the prior-art barrier strips. Accordingly, objects of the present invention are to provide an improved barrier strip which simplifies the process of stopping a fleeing vehicle, maximizes the safety of deployment personnel, and minimizes the danger of accidental tire puncture to non-offending vehicles.

SUMMARY OF THE INVENTION

According to principles of the present invention in its preferred embodiment, a portable barrier strip having retractable tire-puncture means for puncturing a vehicle tire is disclosed. The retractable tire-puncture means allows for deployment personnel to easily and safely deploy the strip at a convenient time, with the tire-puncture means in a retracted position. The tire-puncture means remains in the retracted position until a fleeing vehicle nears, thereby minimizing damage to non-offending vehicles travelling the same path. When the fleeing vehicle nears, the tire-puncture means is activated to an armed position from a remote location to maximize deployment personnel safety.

In its preferred embodiment, the barrier strip comprises a plurality of barrier blocks, having the retractable tire-puncture means disposed in each of the plurality of blocks. The barrier blocks are removably, pivotally, and rotatably interconnected to form the barrier strip.

In its preferred embodiment, a shaft is rotatably disposed in each barrier block and interconnects each barrier block to an adjacent block. Hollow spikes are removably disposed in the shaft, and the shaft is rotated to arm the spikes for puncturing a vehicle tire and counterrotated to retract the spikes for not puncturing a tire. Each spike is received in a hollow-bed portion of its respective barrier block when in a retracted position.

According to further principles of the present invention, the barrier strip rests stable in a deployed position for use and substantially motionless as a tire rolls thereon and over. By resting stable and avoiding movement, i.e., such as a "rocking" movement that is associated with the prior art, the strip retains greater strength and is less susceptible to breakage.

According to further principles of the present invention, the strip is rolled up for easy retrieval, portability, and storage purposes and simply unrolled to an extended position for deployment and use.

According to further principles of the present invention, each tire-puncture means is armed and retracted by a control means. In the preferred embodiment, the control means comprises first and second cables which extend through each barrier block and attach to an end block shaft. The tire-puncture means is activated to the armed position by a pull force on the first cable. Activation occurs from a remote distance and on demand, thereby maximizing the safety of deployment personnel and minimizing the danger of accidental tire puncture to non offending vehicles. The tire-puncture means is disarmed to a retracted position by a pull force on the second cable.

Other objects, advantages, and capabilities of the present invention will become more apparent as the description proceeds.

BRIEF DESCRIPTION OF THE DRAWINGS

FIGS. 5A–C, respectively, depict plan, end, and side views of the rotatable shaft-connecting means for interconnecting each of the plurality of barrier blocks to form the barrier strip.

DETAILED DESCRIPTION OF THE INVENTION

Figure 1:
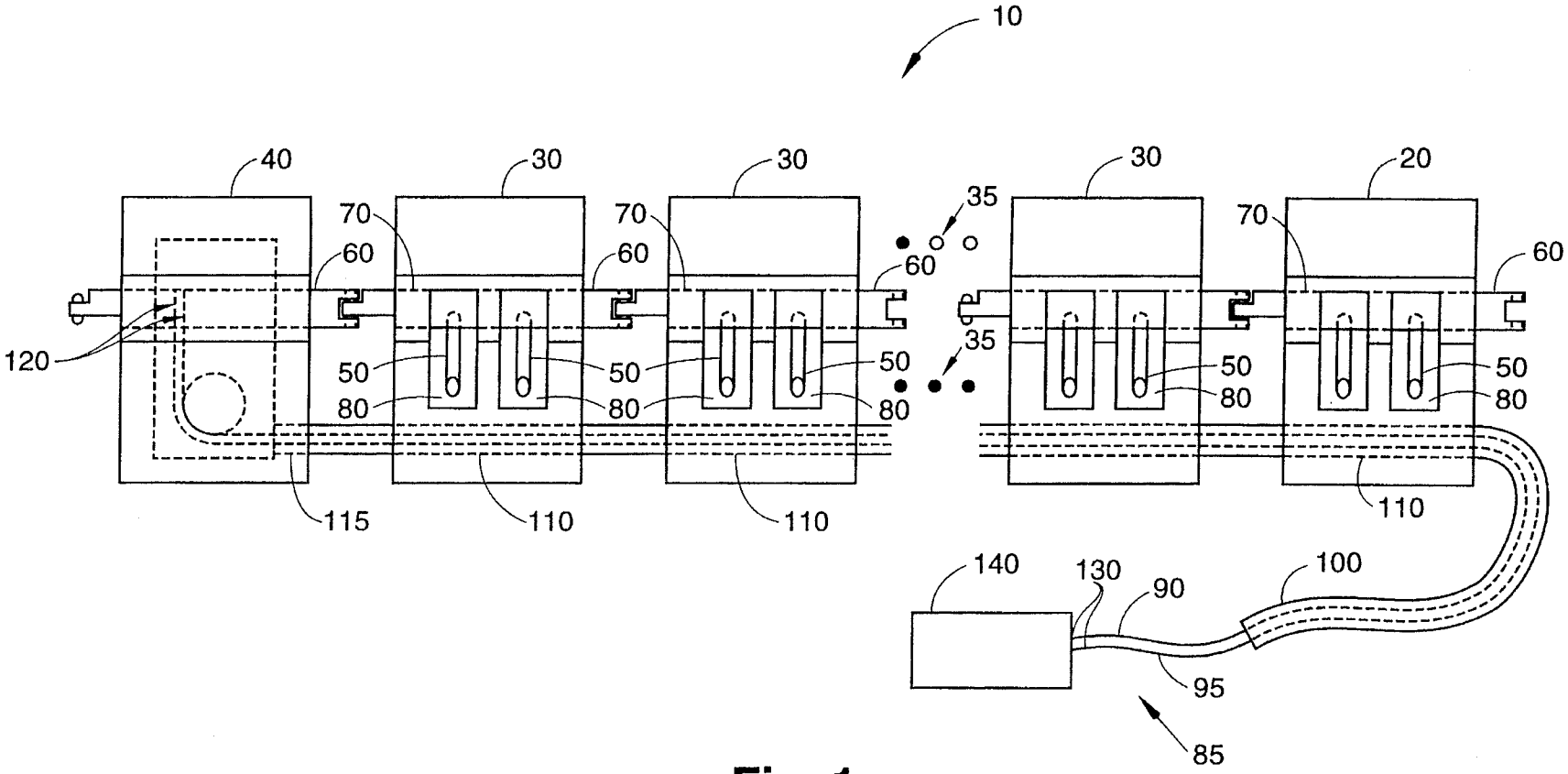
FIG. 1 is a plan view of the present invention barrier strip in its deployed position with the tire-puncture means in a retracted position for not puncturing a vehicle tire.

FIG. 1 depicts a plan view of the present invention barrier-strip means 10 having a plurality of barrier blocks 30 disposed in between and interconnecting first and second-end barrier blocks 20 and 40, respectively. Ellipses 35 indicate a plurality of barrier blocks 30, not shown, sufficient to form the barrier strip long enough to extend across a path of a fleeing vehicle. Barrier strip 10 is unrolled and extended in a deployed position with tire-puncture means 50 in a retracted position, i.e., in a substantially horizontal plane, for not puncturing a vehicle tire.

Each of the barrier blocks 20, 30, and 40 are adjacently interconnected by connecting means 60. Connecting means 60 is a shaft rotatably disposed within a first bore 70 of each block. Tire-puncture means 50 is a hollow spike removably disposed in shaft 60. The spike is received in hollow-bed portion 80, in a substantially horizontal plane in its retracted position, for not puncturing a vehicle tire.

Control means 85 comprises activation means 140, first and second actuation cable 90 and 95, and actuation cable tubing 100. Actuation cables 90 and 95 are housed in tubing 100 which runs through each second bore 110 of each barrier block 20 and 30 and through end-bore 115 of second-end block 40. Cable connection ends 120 of cables 90 and 95 are attached around and to shaft 60 of second-end block 40. Activation means 140 causes a pull force to be selectively exerted on actuation cable 90 or 95 via the respective cable activation end 130, and, consequently, the pull force is transmitted to the respective cable connection end 120 for rotating shaft 60 for arming and retracting tire-puncture means 50.

Namely, a pull force on first actuation cable 90 causes shaft 60 of each barrier block 20, 30, and 40 to be rotated to an armed position wherein spikes 50 extend upward for puncturing a tire. In contrast, a pull force on second actuation cable 95 causes shaft 60 to be counterrotated to a retracted position wherein the spikes are disposed within hollow bed 80, in a substantially horizontal position, for not puncturing a tire.

Although not shown, in an alternate embodiment, a spring means communicates between second-end block 40 and its shaft 60 to automatically counterrotate each interconnected shaft and tire-puncture means to the retracted position. In the alternate embodiment, the spring means replaces the need for second actuation cable 95 of the preferred embodiment.

Activation means 140 can be any means capable of exerting a pull force, including but not limited to, mechanical, electrical, manual, or some combination or other well-known means in the art. Moreover, by running actuation cables 90 and 95 and tubing 100 through second bore 110 of each barrier block 20 and 30 and end bore 115 of second-end block 40, barrier strip 10 is provided with increased stability for deployment, use, and retrieval thereof.

Since barrier strip 10 is easily portable, it is deployed as shown at any time in advance of a fleeing vehicle. Moreover, there is minimal concern for inadvertent damage to non-offending vehicles because of the novel retractable tire-puncture means. Deployment personnel can avoid potentially dangerous conditions because the tire-puncture means remains in the retracted position during deployment and remains retracted until armed on demand. Thus, the strip can be deployed at any time prior to the fleeing vehicle passing and need not be deployed only immediately prior to the vehicle passing. Deployment personnel simply roll out the barrier strip with the tire-puncture means in the retracted position, then wait until the fleeing vehicle approaches to arm the tire-puncture means for puncturing the tire. No damage is caused to any non-offending vehicles that may be travelling the same path because tire-puncture means 50 remains in the retracted position until armed by activation means 140.

Activation means 140 can be placed away from the immediate location of deployed barrier strip 10, limited only by the selectable length of cables 90 and 95. By having activation means 140 away from barrier strip 10, deployment personnel remain safe from any non-offending or fleeing vehicle activity near the strip.

In alternate embodiments, barrier strip 10 is removably or permanently secured to the surface on which it is placed. For example, the strip may be attached to a road surface in a substantially permanent fashion by use of adhesive materials or other means known in the art. Alternatively, the strip is secured in a sunken track across a road, such that the strip is sunken below the surface of the road in the track sufficient to enable only the tire-puncture means to protrude above the surface when in the armed position for puncturing a tire.

Figure 2A:
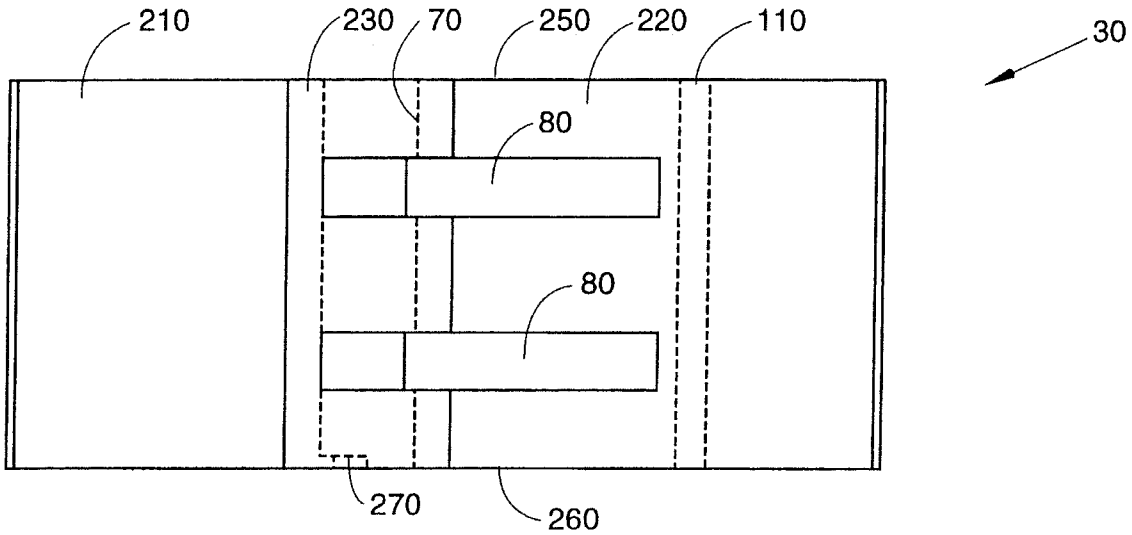
FIGS. 2A–C, respectively, depict plan, side, and end views of a barrier block excluding the connecting means, tire-puncture means, and control means.
Figure 2B:
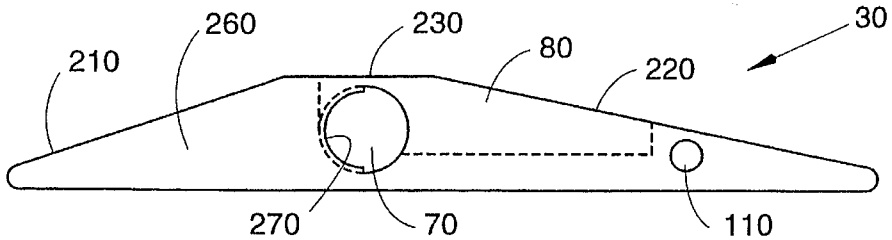
Figure 2C:
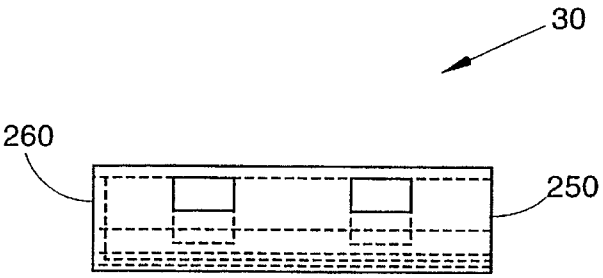
Figure 6A:
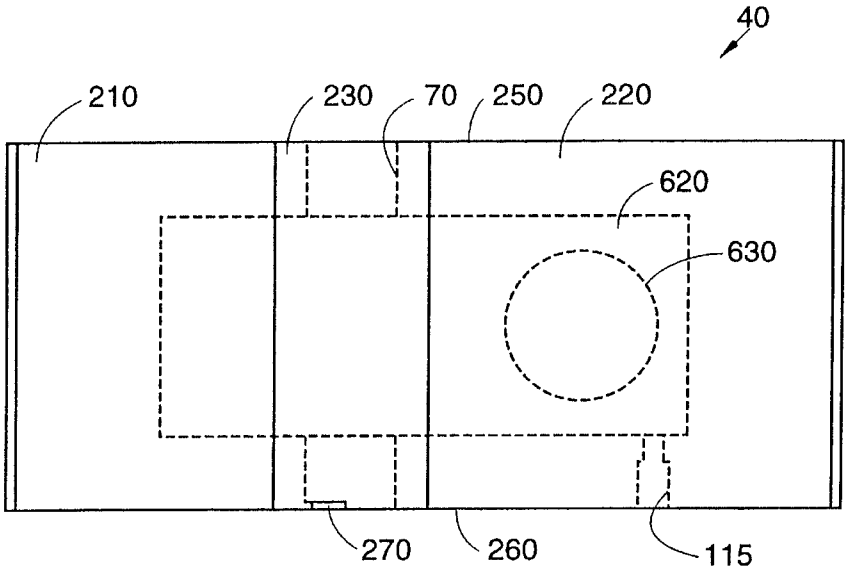
FIGS. 6A–C, respectively, depict plan, side, and end views of a second-end barrier block.
Figure 6B:
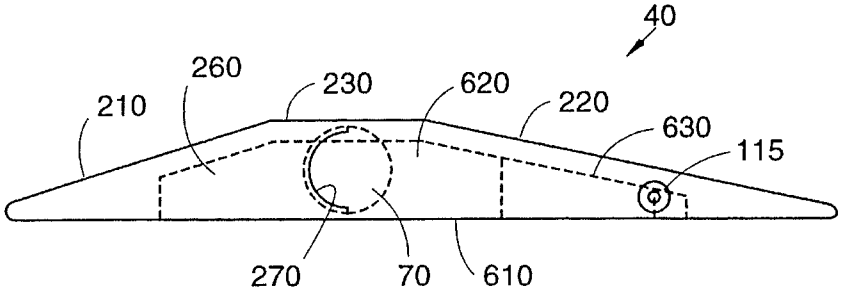
Figure 6C:
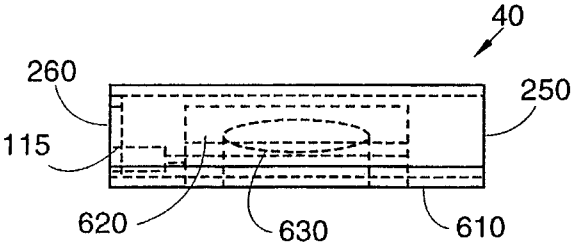

FIGS. 2A–C depict, respectively, a plan, side, and end view of barrier block 30 (from FIG. 1), excluding the connecting means, tire-puncture means, and control means. As depicted in FIGS. 2A–C, barrier block 30 is also representative of first-end barrier block 20. However, second-end barrier block 40 differs slightly, as shown in FIGS. 6A–C.

Barrier block 30 has a face comprising inclined leading-edge surface 210 for receiving a vehicle tire; inclined trailing-edge surface 220 for securing the block in place by the tire after piercing of the tire by the tire-puncture means; top-edge surface 230 communicating between the leading and trailing-edge surfaces; first side-edge surface 250; and second side-edge surface 260. First bore 70 is located substantially below top-edge surface 230 and communicates between first side-edge surface 250 and second side-edge surface 260. Second bore 110 is located substantially below trailing-edge surface 220 and also communicates between first side-edge surface 250 and second side-edge surface 260. Hollow-bed portion 80 is located substantially within top-edge and trailing-edge surfaces 230 and 220 and receives tire-puncture means 50 (FIG. 1) in the retracted position. Lip 270 protrudes from first bore 70 adjacent second side-edge 260 for rotatably retaining connecting means 60 (FIG. 1).

Figure 3A:
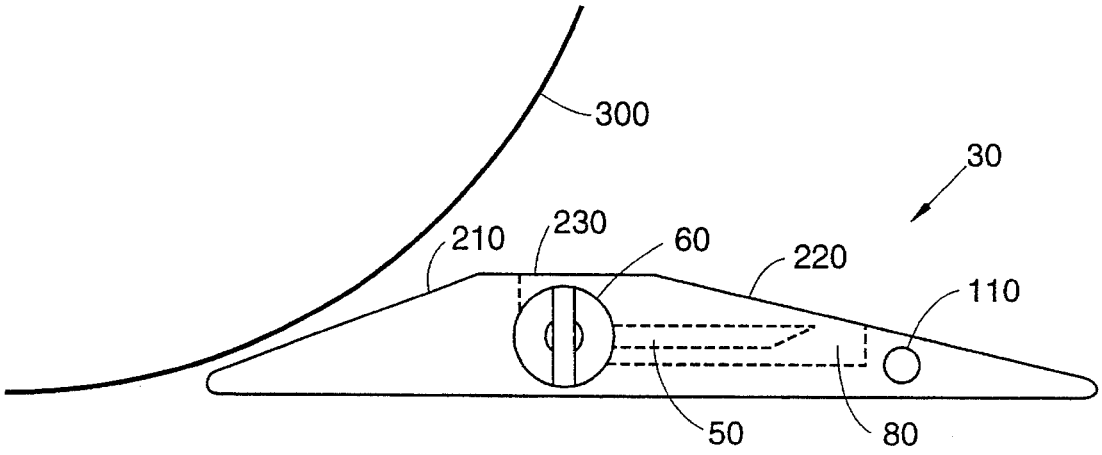
FIG. 3A is a side-elevation view of barrier block 30 having the tire-puncture means in a retracted position for not puncturing a vehicle tire.
Figure 3B:
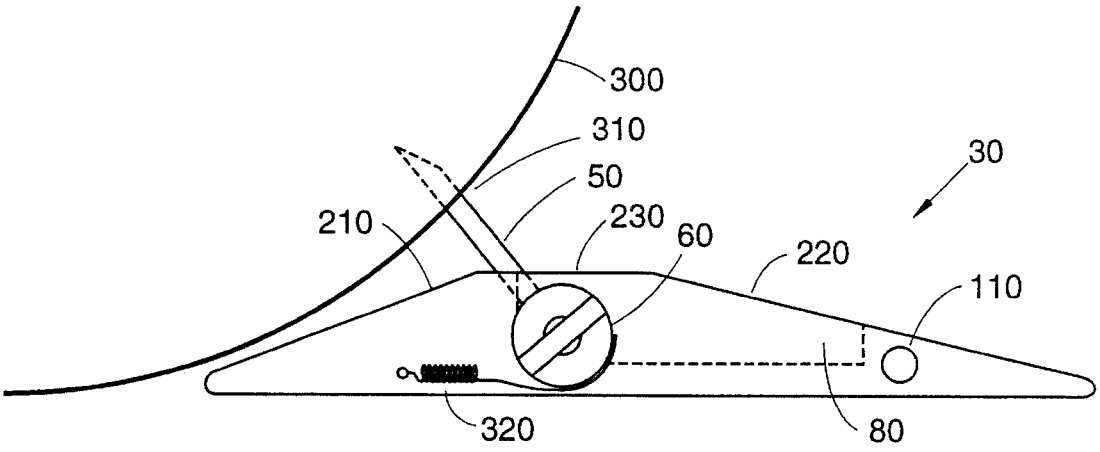
FIG. 3B is a side-elevation view of barrier block 30 having the tire-puncture means in an armed position for puncturing a vehicle tire.

FIGS. 3A and 3B depict a side-elevation view of barrier block 30 having shaft 60 rotatably disposed in first bore 70, and tire-puncture means 50 disposed in shaft 60. FIG. 3A depicts tire-puncture means 50 in its retracted position, with the spike substantially in the horizontal plane, received in hollow-bed portion 80 for not puncturing vehicle tire 300.

FIG. 3B depicts tire-puncture means 50 in the armed position, with the spike extending upward for puncturing vehicle tire 300.

When spike 50 is in the armed position, it extends upward in a direction such that as tire 300 is received by leading-edge surface 210, spike 50 enters the tire at a substantially perpendicular angle relative to the tire at a point of insertion 310 in the fire.

Although not explicitly depicted, as tire 300 continues to roll over barrier block 30, shaft 60 rotates substantially in synchronization with the tire as the tire rolls over the barrier block after being punctured by the spike. As such, the spike is removed from the shaft by the tire at a likewise substantially perpendicular angle relative to the fire, thereby leaving the barrier strip stable and substantially motionless as the tire rolls thereon and over and thereby avoiding excessive tearing of the tire by the spike.

FIG. 3B also shows an alternate embodiment for retracting tire-puncture means 50 to the retracted position. Namely, spring means 320 attaches to block 30 and shaft 60 such that when a pull force on first actuation cable 90 ceases or is less than the force exerted by spring means 320, then shaft 60 and tire-puncture means 50 are counterrotated to the retracted position for not puncturing a tire. Spring means 320 is alternatively attached to either barrier block 20, 30, or 40 and their respective shafts.

Figure 4:
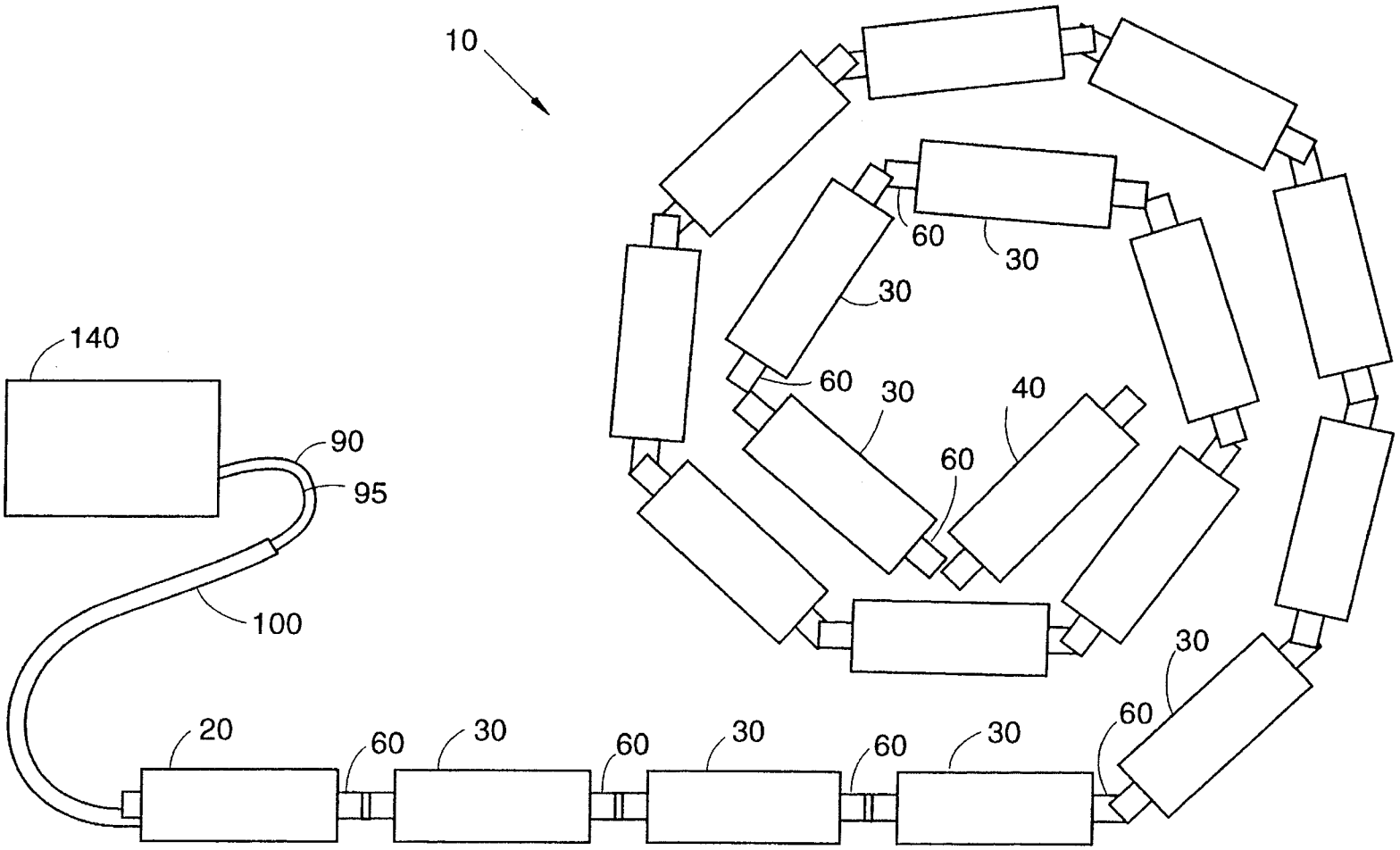
FIG. 4 is an end-elevation view of the barrier strip in a semi-rolled-up position for retrieval, portability, and storage purposes.

FIG. 4 is an end-elevation view of barrier strip 10 in a semi-rolled-up position. Connecting means, shaft 60, pivotally interconnects each of the barrier blocks, 20, 30, and 40. As such, barrier strip 10 is able to be rolled up for retrieval, portability, and storage purposes and simply unrolled and extended for deployment purposes (FIG. 1).

When strip 10 is rolled up, spike 50 is in the retracted position (FIG. 3A) for each barrier block. Shaft 60 pivotally interconnects each block in a manner such that the strip can only be rolled up when spike 50 is in the retracted position. FIGS. 5A–C and their detailed descriptions describe more precisely how and why the strip only rolls up when spike 50 is in the retracted position. This feature ensures safety from the sharp spikes when handling for deployment and retrieval.

FIGS. 5A–C, respectively, depict plan, end, and side views of rotatable shaft 60 for interconnecting each barrier block 20, 30, and 40 forming the barrier strip. Shaft 60 has shaft body 500 and first and second ends 510 and 520, respectively. Shaft 60 is rotatably disposed within first bore 70 (FIG. 1) of each barrier block, and ends 510 and 520 extend outward therefrom. Circular penetration 530 removably receives spike 50 (not shown).

As shown in FIG. 5C, first end 510 has finger extension 540 having nub 550 protruding from both sides of finger 540. Second end 520 has slot 560 aligned with finger 540 of first end 510. Second end 520 also has aperture 570 penetrating there-through, perpendicular to slot 560.

Shaft 60 interconnects each adjacent barrier block by having finger 540 being disposed in a mating slot 560 of an adjacent block shaft. Upon insertion of finger 540 into mating slot 560 of an adjacent shaft, nubs 550 pop into aperture 570 to removably and pivotally secure each adjacent shaft and block. With this nub, finger, and slot interconnection, the barrier blocks are removably interconnected for easy replacement as needed.

Moreover, each shaft is pivotally interconnected, wherein nub 550 and aperture 570 define the pivot point. This pivotal interconnection allows for barrier strip 10 to be rolled up for retrieval, portability, and storage purposes (see FIG. 4) when spike 50 is in the retracted position. The strip can only be rolled up when spike 50 is in the retracted position because circular penetrations 530 which receive spike 50 are placed in the body of shaft 60 perpendicular to slot 560 and finger 540, like unto aperture 570. Thus, when spike 50 is in the retracted position, i.e., substantially in the horizontal plane, finger 540 and slot 560 are in a substantially vertical plane to allow the pivoting of each interconnecting shaft to occur such that the strip may be rolled up. As mentioned, this feature ensures safety from the sharp spikes when handling for deployment and retrieval. In contrast, when spike 50 is in the armed position, finger 540 and slot 560 are in a substantially horizontal plane such that vertical pivotal movement cannot occur, and the strip cannot be rolled up as depicted in FIG. 4.

Groove 580 of FIGS. 5A and 5C defines the means by which shaft 60 is rotatably secured within first bore 70 (FIG. 1) of each barrier block. Groove 580 receives lip 270 (FIGS. 2A–B) and thus rotatably retains shaft 60 within first bore 70.

FIGS. 6A–C, respectively, depict plan, side, and end views of second-end barrier block 40, which differs in construction from barrier blocks 20 and 30 (FIGS. 2A–C) in the preferred embodiment. Barrier block 40 has a face comprising leading, trailing, and top edges 210, 220, and 230 like unto blocks 20 and 30, but block 40 has no hollow-bed portion 80 like unto blocks 20 and 30. Rather, bottom surface 610 has hollowed cavity 620 extending from bottom surface 610 substantially up through block 40 and near unto the face of the block. Cavity 620 extends around circular cable brace 630, and cable brace 630 extends down from trailing-edge surface 220 to bottom surface 610. Cable brace 630 is a solid piece of material although, in alternate embodiments, it comprises some form of pulley wheel(s). End-bore 115 is similar unto second bore 110 of blocks 20 and 30 but communicates between second side-edge 260 and cavity 620 instead of first side-edge 250.

Accordingly, actuation cables 90 and 95 (FIG. 1) run through each barrier block 20 and 30 to second-end block 40. Although not shown, the cables run through end-bore 115, into cavity 620, around and in contact with cable brace 630, and over to shaft 60 disposed in first bore 70. As depicted in FIG. 1, cable connection ends 120 connect with shaft 60 in block 40 to arm and retract tire-puncture means 50.

Namely, when tire-puncture means 50 is in the retracted position (FIG. 3A), first actuation cable 90 runs under, up, and partially around shaft 60 of block 40 to a point where cable connection end 120 of cable 90 connects with shaft 60 (FIG. 1). Whereupon, a pull force on cable activation end 130 of cable 90 is transmitted to cable connection end 120 of cable 90 which causes the shaft to rotate the tire-puncture means to the armed position (FIG. 3B).

In contrast, when tire-puncture means 50 is in the armed position (FIG. 3B), second actuation cable 95 runs over, down, and partially around shaft 60 of block 40 to a point where cable connection end 120 of cable 95 connects with shaft 60 (FIG. 1). Whereupon, a pull force on cable activation end 130 of cable 95 is transmitted to cable connection end 120 of cable 95 which causes the shaft to counterrotate the tire-puncture means to the retracted position (FIG. 3A).

What has been described above are the preferred embodiments for a portable, retractable barrier strip. It is clear that the present invention provides a powerful tool for puncturing a fleeing vehicle's tire while providing maximum safety to non-offending vehicles and to personnel handling the deployment of the strip. While the present invention has been described by reference to specific embodiments, it will be apparent that other alternative embodiments and methods of implementation or modification may be employed without departing from the true spirit and scope of the invention.

What is claimed is:

1. A tire-puncture apparatus for puncturing a vehicle tire, comprising:

a) portable barrier-strip means for communicating with the tire, the barrier-strip means including a plurality of barrier blocks;

b) tire-puncture means disposed in the barrier-strip means, having an armed position for puncturing the tire and a retracted position for not puncturing the tire;

c) control means communicating with the barrier-strip means for arming the tire-puncture means to the armed position and retracting the tire-puncture means to the retracted position; and, d) connecting means for adjacently interconnecting the plurality of barrier blocks, the connecting means having means for securing the tire-puncture means in the retracted position for gathering in the barrier-strip for retrieval, portability, and storage purposes, and for extending out the barrier-strip into a deployed position for use.

2. The tire-puncture apparatus according to claim 1 wherein the barrier-strip means rests stable in a deployed position for use, in the armed and retracted positions, and remains substantially motionless as the tire rolls thereon and over.

3. The tire-puncture apparatus according to claim 2 wherein the barrier-strip means is substantially secured in a location where it is deployed.

4. The tire-puncture apparatus according to claim 1 wherein the barrier-strip means is rolled up for retrieval, portability, and storage purposes and unrolled out in the deployed position for use.

5. The tire-puncture apparatus according to claim 1 wherein each of the plurality of barrier blocks comprises a block of substantially solid material having:

a) a face for the tire to roll thereon and over, having:

i) an inclined leading-edge surface for receiving the tire;

ii) an inclined trailing-edge surface for securing the barrier block in place by the tire after piercing of the tire by the tire-puncture means; and iii) a top-edge surface communicating between the leading and trailing-edge surfaces;

b) a first and second side-edge surface communicating with the face for support thereof;

c) a hollow-bed portion communicating with the face for receiving the tire-puncture means in the retracted position;

d) a first bore communicating between the first and second side-edge surface in a location between the leading- and trailing-edge surfaces substantially below the top-edge surface for receiving the connecting means; and e) a second bore communicating between the first and second side-edge surface in a location substantially below one of the leading-edge or trailing-edge surfaces for receiving the control means.

6. The tire-puncture apparatus according to claim 5 wherein:

a) the connecting means comprises a shaft having a shaft body and first and second shaft ends;

b) the shaft body is rotatably disposed within the first bore and the first and second shaft ends extend outwardly therefrom for interconnecting with a corresponding mating shaft end of an adjacent barrier block; and c) the tire-puncture means is disposed in the shaft body.

7. The tire-puncture apparatus according to claim 6 wherein the tire-puncture means is at least one hollow spike having a base portion removably disposed in the shaft body and a cutting tip extending outwardly away from the shaft body.

8. The tire-puncture apparatus according to claim 6 wherein the armed position of the tire-puncture means comprises the shaft rotated whereby the tire-puncture means extends upward in a direction such that as the tire is received by the leading-edge surface, the tire-puncture means enters the tire at a substantially perpendicular angle relative to the tire at a point of insertion in the tire.

9. The tire-puncture apparatus according to claim 8 wherein the shaft rotates substantially in synchronization with the tire as the tire rolls over the barrier block after being punctured by the tire-puncture means, thereby leaving the tire-puncture apparatus stable and substantially motionless as the tire rolls thereon and over.

10. The tire-puncture apparatus according to claim 6 wherein the retracted position of the tire-puncture means comprises the shaft rotated wherein the tire-puncture means is received within the hollow-bed portion of the barrier block and whereby the tire-puncture means does not communicate with the tire as the tire rolls over the barrier block.

11. The tire-puncture apparatus according to claim 10 wherein the control means comprises an activation means, and first and second actuation cables each having a cable activation end and a cable connection end, and wherein:

a) the first and second actuation cables run through the second bore of each of the interconnecting barrier blocks;

b) the cable connection end of the first and second actuation cables runs partially around and connects to the shaft of a second-end barrier block; and c) the cable activation end of the first and second actuation cables extends outwardly from a first-end barrier block and communicates with the activation means, and wherein the activation means selectively exerts a pull force on the first and second actuation cables causing the second-end barrier block shaft to rotate, and consequently, all other interconnecting barrier block shafts.

12. The tire-puncture apparatus according to claim 11 wherein:

a) the pull force on the first actuation cable causes the shaft to rotate the tire-puncture means from the retracted position to the armed position; and b) the pull force on the second actuation cable causes the shaft to counterrotate the tire-puncture means from the armed position to the retracted position.

13. The tire-puncture apparatus according to claim 12 wherein the control means further comprises a spring means for automatically causing the shaft to counterrotate the tire-puncture means from the armed position to the retracted position.

14. The tire-puncture apparatus according to claim 6 wherein one of the first and second shaft ends includes a slot for interconnecting with a finger of a mating shaft end of an adjacent barrier block, and wherein the tire-puncture means is disposed in the shaft body substantially perpendicular to the slot, whereby when the tire-puncture means is in the retracted position, it is disposed in a substantially horizontal plane relative to the top edge surface of the barrier block, and the slot is in a substantially vertical plane to allow pivoting between each interconnecting shaft such that the barrier strip may be safely gathered in and extended out.

15. The tire-puncture apparatus according to claim 1 wherein the connecting means removably interconnects each of the plurality of barrier blocks.

16. The tire-puncture apparatus according to claim 1 wherein the connecting means pivotally interconnects each of the plurality of barrier blocks.

17. The tire-puncture apparatus according to claim 1 wherein the connecting means rotatably interconnects each of the plurality of barrier blocks.

18. A barrier strip for puncturing a vehicle tire, comprising:

a) a plurality of adjacent barrier blocks, each block having a face for the tire to roll thereon and over, a hollow-bed portion disposed within the face, and a first and second bore;

b) connecting means comprising a shaft rotatably disposed in the first bore of each block, wherein the shaft pivotally and removably interconnects with a corresponding mating shaft of an adjacent barrier block;

c) tire-puncture means removably disposed in the shaft of each of the barrier blocks, and wherein the shaft is rotated to an armed position for puncturing the tire, and counterrotated to a retracted position wherein the tire-puncture means is received within the hollow-bed for not puncturing the tire; and d) control means comprising first and second actuation cables running through the second bore of each of the interconnected blocks, each cable having a cable connection end for connecting to the shaft of a barrier block, and a cable activation end for communicating with an activation means, and wherein a pull force selectively exerted by the activation means on the first actuation cable causes each interconnecting shaft to rotate the tire-puncture means to the armed position, and a pull force selectively exerted by the activation means on the second actuation cable causes each interconnecting shaft to counterrotate the tire-puncture means to the retracted position; and wherein the tire puncture apparatus is rolled up for retrieval, portability, and storage purposes and unrolled and extended in the deployed position for use, and wherein the strip rests stable in a deployed position of use and remains substantially motionless as the tire rolls thereon and over the strip.

* * * * *